US010165901B2

(12) United States Patent
Peterson

(10) Patent No.: US 10,165,901 B2
(45) Date of Patent: Jan. 1, 2019

(54) TOOTHBRUSH HOLDER APPARATUS

(71) Applicant: Vacharee Peterson, Maplewood, MN (US)

(72) Inventor: Vacharee Peterson, Maplewood, MN (US)

( * ) Notice: Subject to any disclaimer, the term of this patent is extended or adjusted under 35 U.S.C. 154(b) by 0 days.

(21) Appl. No.: 15/653,813

(22) Filed: Jul. 19, 2017

(65) Prior Publication Data

US 2018/0020877 A1 Jan. 25, 2018

Related U.S. Application Data

(60) Provisional application No. 62/366,366, filed on Jul. 25, 2016.

(51) Int. Cl.

| | |
|---|---|
| ***A47K 1/09*** | (2006.01) |
| ***A47G 29/08*** | (2006.01) |
| ***A46B 17/02*** | (2006.01) |

(52) U.S. Cl.

CPC ..... *A47K 1/09* (2013.01); *A46B 17/02* (2013.01); *A47G 29/08* (2013.01); *A46B 2200/1066* (2013.01)

(58) Field of Classification Search

CPC ... A46B 2200/1066; A46B 5/02; A46B 17/02; A46B 5/025; A46B 15/0002; A46B 17/00; A46B 5/023

See application file for complete search history.

(56) References Cited

U.S. PATENT DOCUMENTS

| | | | | | |
|---|---|---|---|---|---|
| 3,755,848 | A | * | 9/1973 | Mutrie | A46B 5/0095 132/311 |
| 4,283,808 | A | * | 8/1981 | Beebe | A46B 5/02 15/145 |
| 4,476,604 | A | * | 10/1984 | White | A46B 15/0002 15/105 |
| 4,558,483 | A | * | 12/1985 | Noser | A46B 5/02 15/143.1 |
| 4,621,387 | A | * | 11/1986 | Noser | A46B 5/02 15/143.1 |
| 4,680,825 | A | * | 7/1987 | White | A46B 15/0002 116/202 |
| D301,937 | S | * | 7/1989 | Thompson | D4/104 |
| 5,036,562 | A | * | 8/1991 | Reynolds | A46B 5/0062 15/105 |

(Continued)

*Primary Examiner* — Bradley Duckworth

(74) *Attorney, Agent, or Firm* — Shwegman Lundberg & Woessner, P.A.

(57) ABSTRACT

A toothbrush holder apparatus can include a toothbrush and a handle. The toothbrush can include a distal end with bristles. The handle can include a gripping portion and a cavity configured to hold the toothbrush. The handle can include a secured configuration and an unsecured configuration. In the secured configuration, the toothbrush can be secured within the handle with a support feature. In the unsecured configuration, the toothbrush is removable from the handle. A stopper can be coupled to the handle. The stopper can be located at a distance from the distal end of the toothbrush. An adapter can extend from the stopper and include an opening to the cavity. The adapter can have a convex shape extending from the stopper. The toothbrush can be located within the opening, and a support feature configured to hold the toothbrush within the handle.

7 Claims, 6 Drawing Sheets

(56) References Cited

U.S. PATENT DOCUMENTS

| | | | | | |
|---|---|---|---|---|---|
| 5,353,464 | A * | 10/1994 | Atkins | A46B 5/00 | 15/143.1 |
| 5,361,446 | A * | 11/1994 | Rufo | A46B 5/0095 | 15/167.1 |
| 5,507,641 | A * | 4/1996 | Cline | A46B 15/0048 | 15/167.1 |
| 6,049,936 | A * | 4/2000 | Holley | A46B 5/02 | 15/143.1 |
| 6,334,231 | B2 * | 1/2002 | Safieh | A46B 5/02 | 15/143.1 |
| 6,363,568 | B1 * | 4/2002 | Harrison | A46B 5/00 | 15/167.1 |
| 2016/0075009 | A1 * | 3/2016 | Ptak | B25G 1/10 | 30/526 |

* cited by examiner

TOOTHBRUSH HOLDER APPARATUS

PRIORITY

This application claims the benefit of priority to U.S. Provisional Patent Application Ser. No. 62/366,366, filed Jul. 25, 2016, which is incorporated by reference herein in its entirety.

BACKGROUND

A toothbrush is a common dental hygiene item that has been adapted into many shapes to allow teeth cleaning for persons of all ages. For example, many childrens' toothbrush designs include fewer bristles and shorter handles to better adapt to a child's smaller mouth opening and fewer teeth. Preschool children between the ages of 2 and 5 (and even younger children with emerging baby teeth) are in need of regular teeth brushing to help prevent cavities and tooth decay. As a result, tooth brushing activities for young children are often are assisted by a parent or caregiver to properly brush all of the child's teeth. However, parents and caregivers may encounter issues and struggles when assisting a child to brush the child's teeth, because the traditional toothbrush shape is designed for self-use, and because the traditional toothbrush shape may be hard to safely manipulate in the child's mouth.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Design configurations, shapes, and methods of manufacture and use for a toothbrush holder apparatus are generally disclosed herein. In one example, the apparatus is designed into a generally tubular, cylindrical shape for the holding and presentation of a toothbrush, such as a children's toothbrush. This configuration of the apparatus, further referred to herein as a toothbrush holder apparatus, features a transitioning stopper (e.g., dome-shaped, tapered, or curved safety feature) at the end of a handle (e.g., generally cylindrical gripping portion). The handle is designed to enable an adult or caregiver to hold and manipulate the toothbrush to brush a child's teeth, while the stopper is designed to inhibit or prevent over-insertion of the toothbrush into a child's mouth. As a result, the toothbrush holder apparatus includes a shape that is designed to prevent jamming, choking, or other injury from improper or accidental insertion of the toothbrush.

As further discussed herein, the toothbrush apparatus may be shaped from a single integrated unit, such as including a children's toothbrush that is affixed and coupled within an interior cavity of the handle (with the handle including the gripping portion and the stopper). In one example, the handle structure may be designed from a mold of a plastic, or other hardened or rigid material. The child-sized toothbrush (such as integrating an existing manufactured design of a child toothbrush) may be placed and coupled within the interior cavity of the handle, and coupled with the use of plastic welding, adhesives, or a like permanent or semi-permanent holding mechanism that is applied during a manufacture of the assembly.

In another example, the toothbrush holder apparatus may be shaped from two portions, with a toothbrush (e.g., child toothbrush) that is separable from the handle. For example, the child-sized toothbrush unit may be placed and temporarily held within an interior cavity of the handle structure portion by a gripping portion, allowing the toothbrush to be removed and replaced (e.g., for cleaning, or for replacement with another toothbrush unit).

FIGS. 1A to 1G depict an example child toothbrush holder, depicted in U.S. Design patent application Ser. No. 07/403,326, filed by the present inventor Vacharee S. Peterson on Sep. 6, 1989, and titled "Tooth Cleaning Device for Preschool Children." This design patent application is incorporated by reference herein in its entirety, and provides a contextual example of a toothbrush holder apparatus adapted for use with children toothbrushing activities.

Figure 1A:
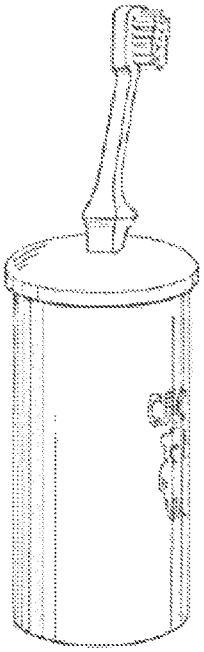
FIG. 1A (PRIOR ART)
FIGS. 1A to 1G illustrate perspective, side, front, top, and bottom view sketches of an example toothbrush holder apparatus.

As shown, FIG. 1A provides a perspective view of the toothbrush holder. As shown, the toothbrush holder includes a handle (e.g., simple round cylindrical portion), a stopper affixed to a top end of the handle, and a separable toothbrush that has been inserted into the toothbrush holder via an opening in the stopper. For example, the toothbrush received by the toothbrush holder may be a reduced-sized child toothbrush design, although larger and adult sized toothbrush designs may also be used with the toothbrush holder.

Figure 1E:
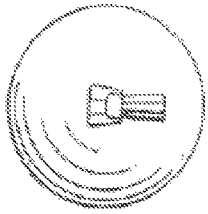
FIG. 1E (PRIOR ART)
Figure 1F:
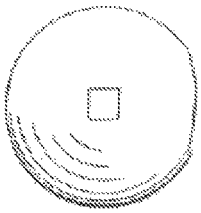
FIG. 1F (PRIOR ART)
Figure 1G:
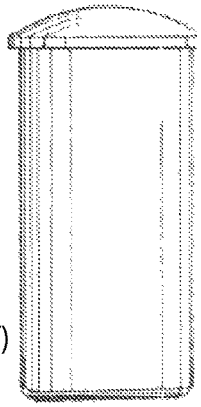
FIG. 1G (PRIOR ART)
Figure 1B:
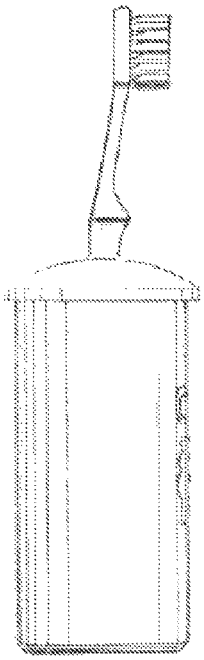
FIG. 1B (PRIOR ART)
Figure 1C:
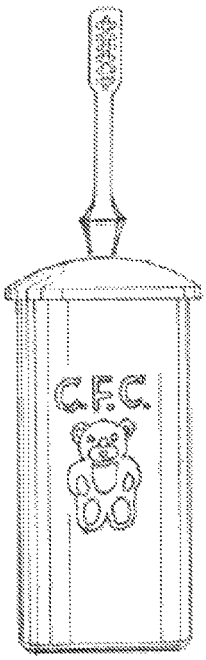
FIG. 1C (PRIOR ART)
Figure 1D:
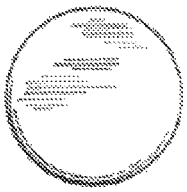
FIG. 1D (PRIOR ART)

In addition to the illustration of FIG. 1A, other drawings depict this toothbrush holder, including FIG. 1B that provides a side elevational view; FIG. 1C that provides a front elevational view, further illustrating the stopper provided on the handle; FIG. 1D provides a bottom plan view; FIG. 1E provides a top plan view of the stopper; FIG. 1F provides a top plan view of the stopper, with the toothbrush being removed for clarity of illustration; and finally FIG. 1G provides an illustration of a rear elevational view, with the toothbrush being removed for clarity of illustration.

The present disclosure provides examples of a modified toothbrush holder design that provides an improvement to the configuration illustrated in FIGS. 1A to 1G. Whereas the configuration of FIGS. 1A to 1G provide a handle, such as a simple cylindrical handle feature, for human manipulation of an attached toothbrush, a significant portion of the toothbrush remains presented to the child in an upright fashion, which again may lead to jamming, choking, or other injury if improperly inserted into a child's mouth. As a result, the present disclosure includes an improved design to the toothbrush holder of FIGS. 1A to 1G, to integrate additional safety and comfort features to the exposed portion of the child toothbrush.

Figure 2:
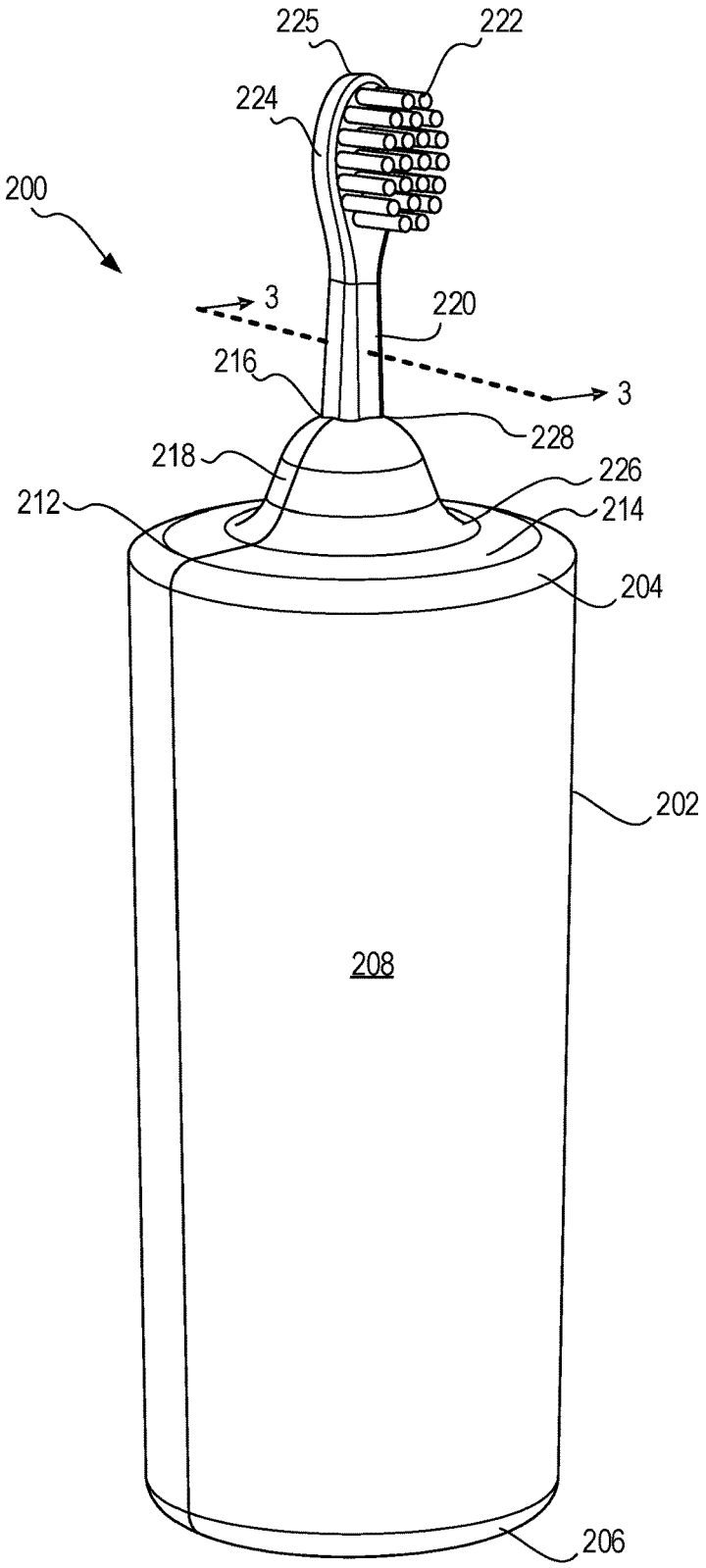
FIG. 2 illustrates a perspective view of a toothbrush holder apparatus, according to an example.

FIG. 2 illustrates a perspective view of a toothbrush holder apparatus 200. The toothbrush holder apparatus 200 can include a handle 202 having a first end 214 and a second end 206 with a gripping portion 208 extended therebetween. As shown, the toothbrush holder includes an adapter 218, provided as a safety feature, which is coupled to an end of a handle 202. The example of the toothbrush holder apparatus 200 includes a stopper 212 (e.g., cap) that is mounted to a top end of the handle 202, with the stopper 212 structured to connect the handle 202 with the adapter 218. The stopper 212 as shown includes a transition feature 204 at the first end 214 (e.g., platform) of the handle 202, with the transition feature 204 including a surface that transitions into the side walls of the handle 202, and the first end 214 including a surface that transitions into the adapter 218.

The adapter 218 includes an opening 216 at the center of the adapter 218 to receive or expose a toothbrush 220. In some examples, the adapter 218 can include a conical shape as shown in the examples of FIGS. 2-17. The interior of the handle 202 defines an interior cavity (shown in detail in FIG. 3) that includes features to hold and secure the handle of toothbrush 220. The adapter 218 includes a second end 226 in a circular configuration to match and integrate with the stopper 212, and a first end 228 opposite of the second end 226 that hosts the opening 216 for the toothbrush 220 to extrude from the adapter 218. The toothbrush 220 can include a toothbrush handle and a toothbrush head 224 located at a distal end 225 of the toothbrush 220. For example, as shown, the toothbrush head 224 extends from the handle of the toothbrush 220, and includes bristles 222 extending from the end of the toothbrush head 224, to expose the operable portion of the toothbrush 220 (while the adapter 218 provides a reduced exposure of the handle of the toothbrush 220). For instance, the distal end 225 can be located at a distance (e.g., a first distance) from the stopper 212. In an example, the distance can be the difference between distance 302 and distance 304 or the difference between distance 302 and distance 306, as shown in the examples of FIG. 3.

The adapter 218 can include a shape that gradually transitions from the second end 226 towards the first end 228, such as by defining a dome-like feature that is tapered at a first angle between the second end 226 and a center area of the adapter 218, and at a second angle between the center area of the adapter 218 and the first end 228. The size and shape of the adapter 218 may be modified based on the opening size and depth of a typical preschool child's mouth, for example, to allow insertion of the toothbrush head 224 and bristles 222 fully into the child's mouth but preventing insertion of additional portion of the toothbrush in the child's mouth beyond a typical location of the rear teeth. In an example, the adapter 218 can be configured to prevent over-insertion of the toothbrush 220 into the mouth of a person by configuring the distance between the distal end 225 of the toothbrush 220 and the adapter 218 to be no greater than a distance between a face of the person and a third molar.

Figure 3:
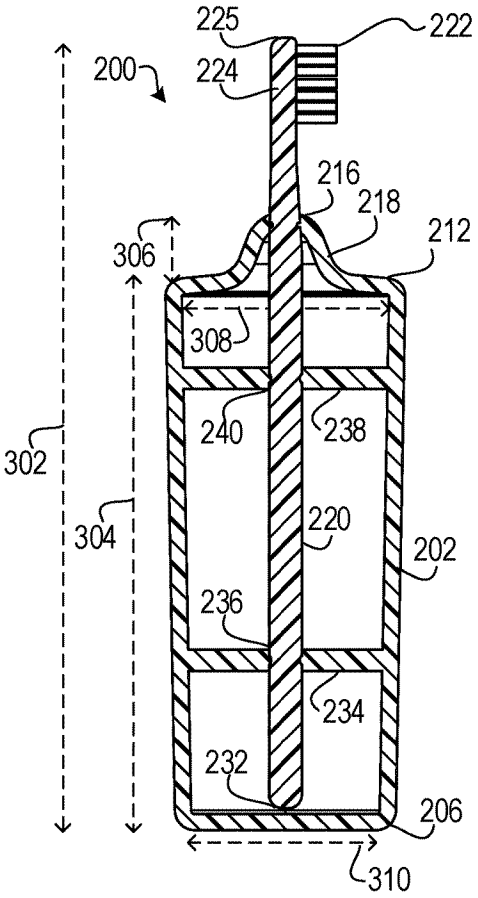
FIG. 3 illustrates a cross-section view of the toothbrush holder apparatus including toothbrush and handle portions, according to an example.
Figure 9:
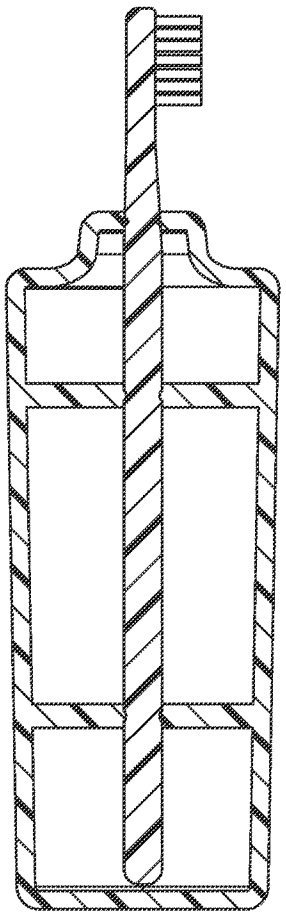
FIGS. 6 to 17 illustrate cross-section views of respective shapes of a toothbrush holder apparatus, according to various examples.
Figure 8:
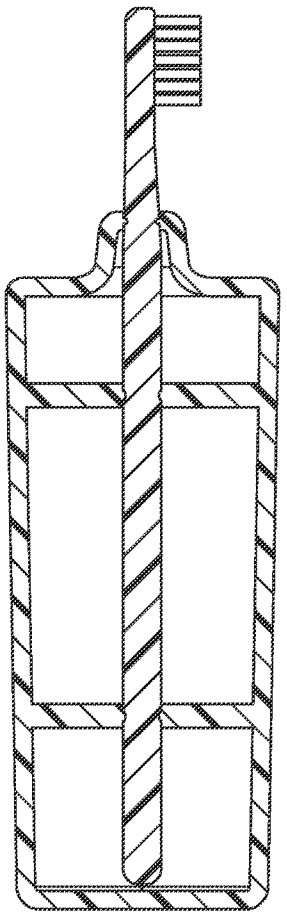
Figure 7:
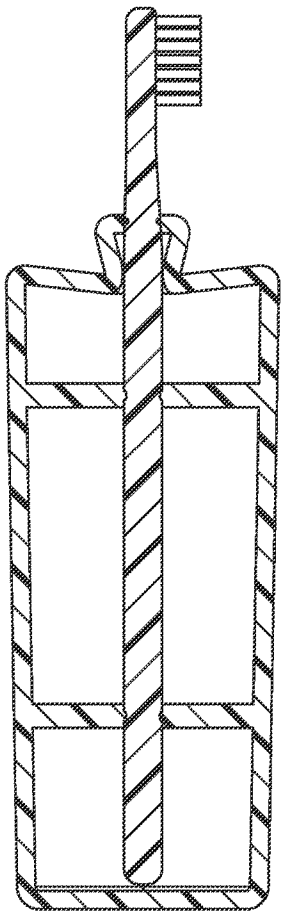
Figure 6:
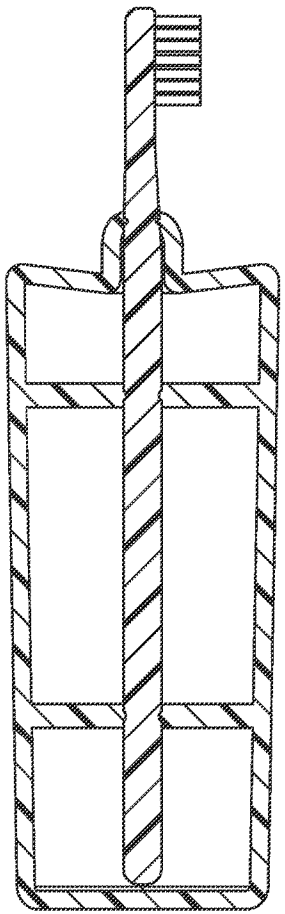
Figure 13:
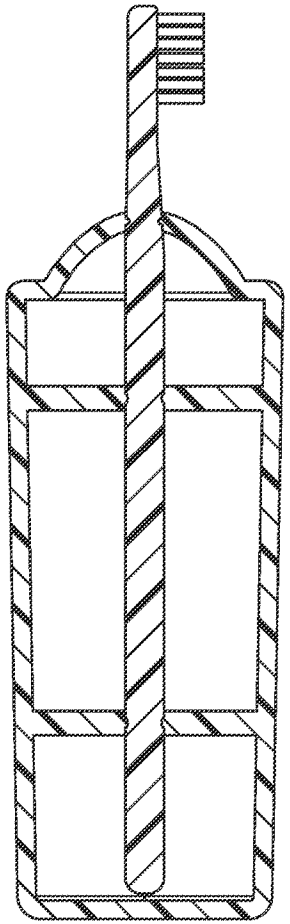
Figure 12:
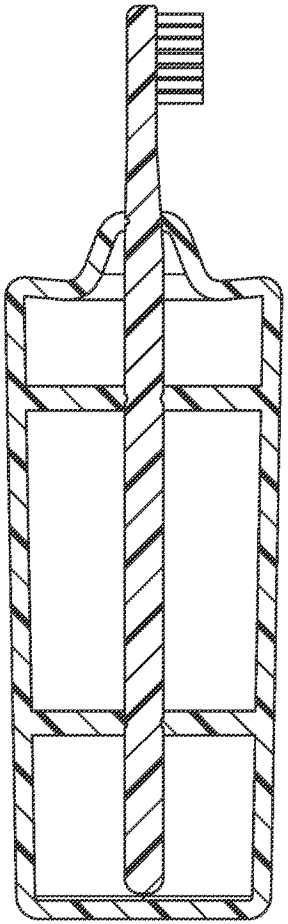
Figure 11:
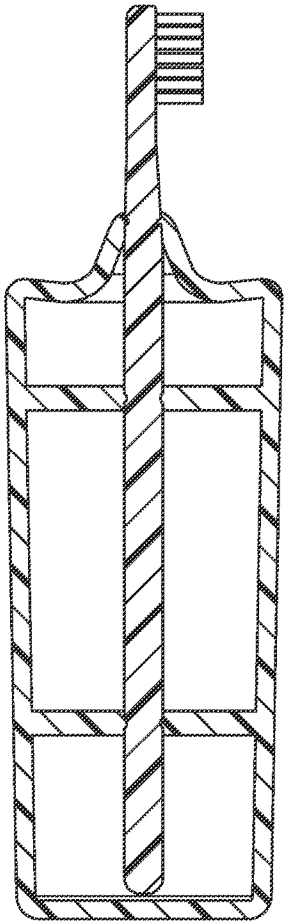
Figure 10:
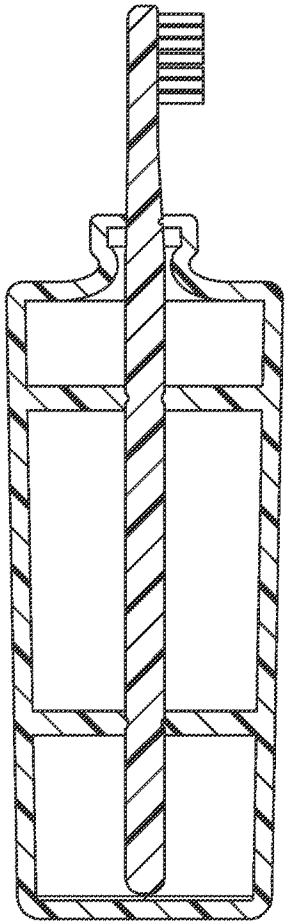
Figure 17:
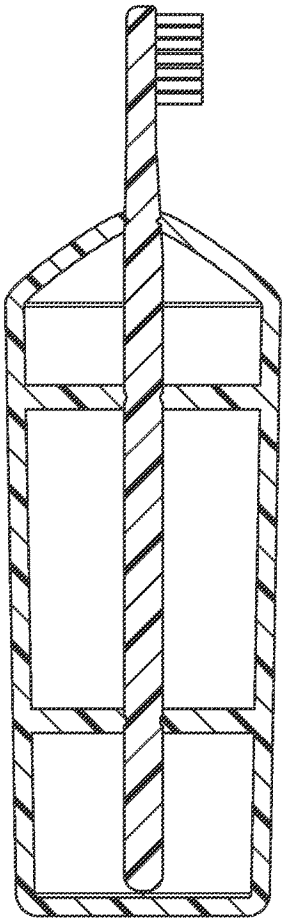
Figure 16:
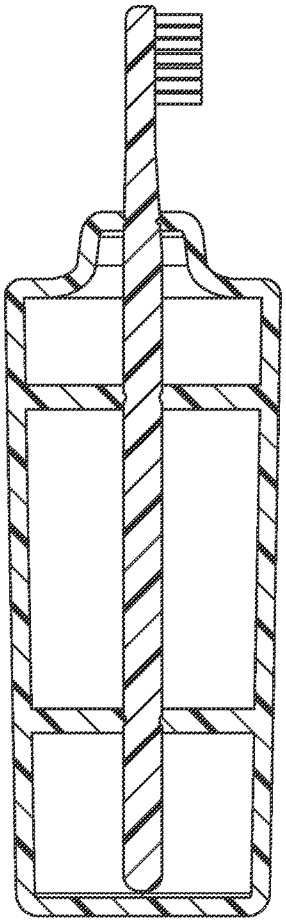
Figure 15:
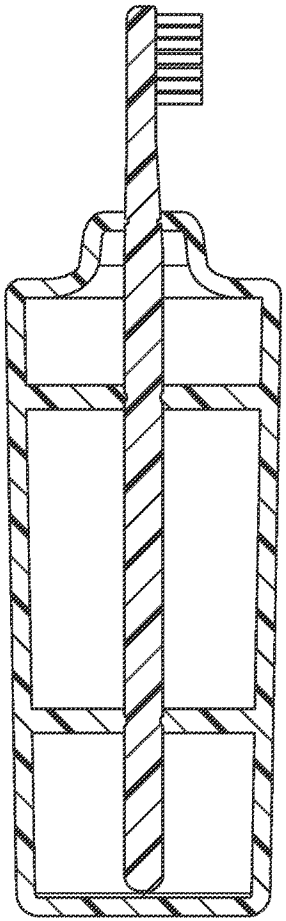
Figure 14:
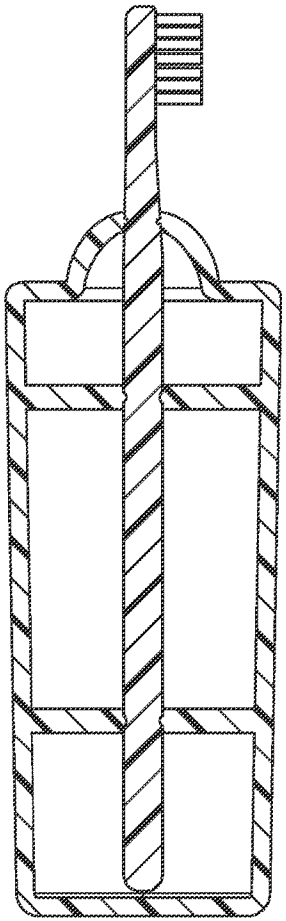

FIG. 3 illustrates a cross-section view of the toothbrush holder apparatus 200 of FIG. 2 including an integrated toothbrush 220 and handle 202. As shown, the toothbrush holder apparatus 200 includes the toothbrush 220 with a handle 202 that extends from a first (bottom) end 232 of an interior cavity defined by the handle 202 and through the exterior opening 216 on a second end of the interior cavity defined by the handle 202. For instance, in some examples, the interior cavity can extend from the opening 216 or the interior cavity can include the opening 216 at one end. Consequently, the toothbrush head 224 and all bristles 222 extend from the opening 216 at the top of the handle 202 (in an example, the distance between the opening 216 and the distal end 225 can be between 5 and 45 mm from the opening 216).

The cross-section view of FIG. 3 further illustrates the connection between the adapter 218 and the handle 202, with the adapter 218 including a curved portion extending from the first end 214 (e.g., stopper 212) of the handle 202 to the opening 216 that exposes the toothbrush 220. The shape and features of adapter 218 are designed to prevent or inhibit insertion of the toothbrush apparatus into a child's mouth beyond the adapter 218, preventing over-insertion of the toothbrush 220. In some examples, the handle 202 and the stopper 212 can include respective outer dimensions (e.g., dimension 310) transverse to a longitudinal axis of the handle 202 that are more than twice a width of the toothbrush 220. In the example of FIG. 3, the size, shape, and location of the stopper 212 can be configured to prevent over-insertion of the toothbrush 220 into a person's mouth, such as a child's mouth. Accordingly, the shape and features of the handle 202 are designed to allow manual manipulation and holding by a child or an adult hand and prevent over-insertion into the mouth of the child or adult.

In an example, the total height of the toothbrush apparatus (extending from a first, distal end 225 of the toothbrush head 224 that extends beyond the handle 202, to a second, bottom end of the toothbrush at the first end of the interior cavity defined by the handle 202) that corresponds to dimension 302 is approximately 155 mm (millimeters). The distance defined by the adapter 218 corresponding to dimension 306 is approximately 20 mm. A first distance (e.g., the difference between dimension 302 and dimension 306) can be greater than the dimension 306 (e.g., second distance). The height defined by the handle 202 (below the adapter 218) that corresponds to dimension 304 (e.g., between the first end 214 and the second end 206 of the handle) is approximately 108 mm. The maximum interior diameter of the interior chamber, located at the top of the interior chamber defined by the handle 202 and that corresponds to dimension 308 is approximately 40 mm. The interior diameter of the bottom of the interior chamber defined by the handle 202 and that corresponds to dimension 310 is approximately 38 mm. In the depicted example of FIG. 3, the distal end 225 of the toothbrush head 224 extends at a distance approximately 34 mm between the opening 216 at the first end 214 of the handle 202 (e.g., at the stopper 212 or the adapter 218) and the distal end 225 of the toothbrush 220. However, a variety of other toothbrush head designs and shapes may be used with aspects of the presently disclosed toothbrush apparatus which would modify these dimensions. Further, a variety of stylistic and functional modifications to the interior or exterior dimensions of the toothbrush apparatus may also be provided.

In an example, the toothbrush 220 is affixed to the toothbrush holder apparatus 200 at the time of manufacture, providing a permanent assembly that cannot be removed. For instance, the handle 202 can include at least two portions (e.g., halves). Accordingly, the handle 202 can include a secured configuration and an unsecured configuration. In the secured configuration, the toothbrush 220 can be secured within the handle 202. In the unsecured configuration, the toothbrush 220 can be removable from the handle 202. In a further example, a first portion of the handle 202 can be hingedly attached to a second handle portion. In other examples, plastic welding techniques (such as sonic welding) may be used at holding locations 236 and 240, to permanently fuse a pre-manufactured toothbrush 220 into the interior cavity of the toothbrush holder apparatus 200. In a further example, the interior cavity of the toothbrush holder apparatus 200 may include support features 234, 238, such as a molded plastic plate (e.g., support plates) extending across a diameter of the internal cavity. As shown, the support features 234, 238 may be integrated into the same assembly (e.g., the same plastic molding) as the handle 202. Thus, in some examples, the interior cavity of the toothbrush holder apparatus 200 may be divided into three sub-cavities. Additional or fewer support features may be used based on the desired stability and removability of the toothbrush holding, or the shape of the handle 202 or the toothbrush 220. In some examples the support features, such as support features 234, 238 can clamp the toothbrush 220 within the handle 202.

In further examples, the toothbrush holder apparatus 200 includes temporary holding features in place of holding locations 236 and 240 (or elsewhere) that allow the insertion and full removal of the toothbrush 220. Also in further examples, the toothbrush head 224 or other contained portion of the toothbrush 220 may be removed, allowing replacement of the toothbrush head 224 or the contained portion of the toothbrush 220.

Figure 4:
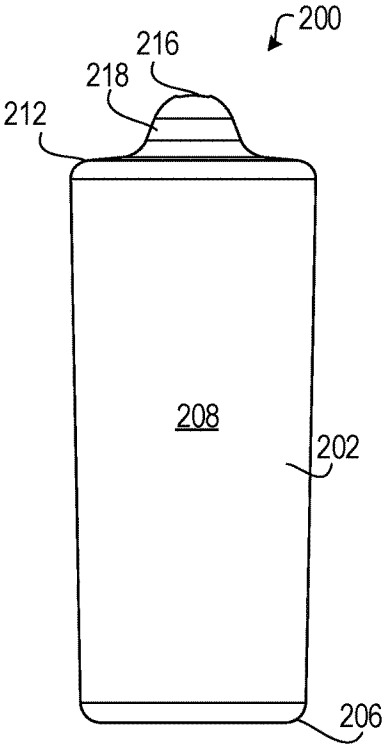
FIG. 4 illustrates a front view of a handle of the toothbrush holder apparatus, with the toothbrush removed for purposes of illustration, according to an example.

FIG. 4 illustrates a front view of the handle 202 of the toothbrush holder apparatus 200, with the toothbrush 220 removed for purposes of illustration, according to an example. Consistent with the previous depictions, the toothbrush holder apparatus 200 includes an opening 216 at a first end of the handle 202, which is opposite the bottom, second end 206 defining a floor of the handle 202. The gripping portion 208 of the handle 202 may be colored, include various ornamental shapes and designs, coated with various grip materials, and include any number of enhancements for aesthetic or functional purposes.

Figure 5:
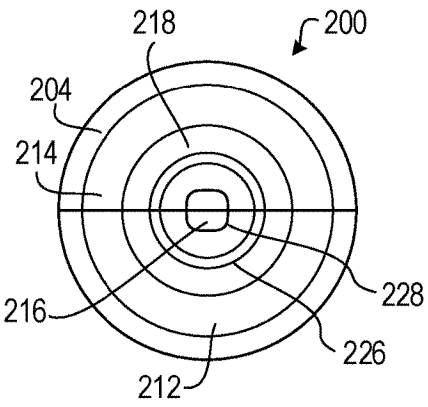
FIG. 5 illustrates a top view of the toothbrush holder apparatus, with the toothbrush removed for purposes of illustration, according to an example.

FIG. 5 illustrates a top view of the toothbrush holder apparatus 200, with the toothbrush 220 removed for purposes of illustration, according to an example. As shown in the top view, the toothbrush holder apparatus 200 includes an opening 216 from which a toothbrush 220 can extend from. In some examples, the opening 216 includes features to allow insertion and removal of the toothbrush 220. In some other examples, the opening 216 is used with securing features (such as adhesive, sonic welding) to integrate the toothbrush 220 to the toothbrush holder apparatus 200 and prevent air or water from entering the interior cavity of the handle 202.

FIG. 5 further illustrates a top view of the adapter 218, which extends from the first end 228 (adjacent to the opening 216) to the second end 226 (adjacent to the first end 214 of the handle 202, i.e., the stopper 212). The first end 214 of the handle (e.g., the stopper 212) is further depicted as extending from the adapter 218 to the transition feature 204. (The gripping portion 208 is not depicted in FIG. 5, as the examples of FIGS. 2 to 4 illustrate the shape of the handle 202 being gradually narrowed from top to bottom).

FIGS. 6 to 17 illustrate cross-section views of respective shapes of a toothbrush holder apparatus (e.g., similar to toothbrush holder apparatus 200), according to various examples. Specifically, FIGS. 6 to 17 respectively depict different shapes and configurations of a stopper (e.g., similar to stopper 212) integrated to a handle (e.g., similar to handle 202). It will be understood that the toothbrush holder apparatus 200 that is depicted in FIGS. 2 to 5 may be varied using features of the stopper 212 depicted in FIGS. 6 to 17. It will also be understood that the shape of the handle and the exposing of the toothbrush handle in the assemblies of FIGS. 6 to 17 may other variations, to allow changes to the size, orientation, shape, and materials of the toothbrush holder apparatus.

The following is an example of a method for constructing a toothbrush holder apparatus, such as the toothbrush holder apparatus 200 previously described in the examples herein and shown for instance in FIGS. 1-17. In describing the method, reference is made to one or more components, features, functions, and processes previously described herein. Where convenient, reference is made to the components, features, processes and the like with reference numerals. Reference numerals provided are exemplary and are nonexclusive. For instance, features, components, functions, processes, and the like described in the method include, but are not limited to, the corresponding numbered elements provided herein. Other corresponding features described herein (both numbered and unnumbered) as well as their equivalents are also considered.

The toothbrush can be placed into a cavity of a handle having a secured configuration and an unsecured configuration. The handle can include a grip located between a first end and a second end of the handle, a stopper located at the first end, and an adapter extending from the stopper and including an opening to the cavity, wherein the toothbrush is locatable within the opening. In some examples, placing the toothbrush into the cavity of the handle can include clamping the toothbrush with at least one support feature within the handle to hold the toothbrush. In a further example, placing the toothbrush into the cavity of the handle can include placing the toothbrush into the handle having respective outer dimensions of the handle and the stopper that are more than twice a width of the toothbrush transverse to a longitudinal axis of the handle.

Next, a distal end of the toothbrush can be located at a distance from the stopper. For instance, in some examples, locating the distal end of the toothbrush at the distance from the stopper can include adjusting the distance to be no greater than a distance between a face and a third molar of the person (e.g., child or adult).

Further, the toothbrush can be secured within the handle. Securing the toothbrush within the handle includes adhering a first portion of the handle to a second portion of the handle. Securing the toothbrush within the handle includes sonic welding a first portion of the handle to a second portion of the handle.

The handle of the toothbrush holder apparatus is depicted herein as including a right circular cylinder shape (e.g., fully round), but it will be understood that the other variations to the cylinder shape may be provided. Such other variations may include shapes of an elliptic cylinder (e.g., oval shaped), oblique cylinder (e.g., where the lateral surface of the cylinder is not perpendicular to the end planes), or other deviation or variation to the round shape of the cylinder. In other examples, the toothbrush holder handle may be shaped as a rectangle or as another multi-sided cubical object (including in examples where the rectangular shape includes gradual curves and gradients).

The toothbrush holder apparatus examples discussed herein may be manufactured from any number of solid or rigid materials, such as plastic (e.g., Polypropylene, high or low density Polyethylene, Polyethylene terephthalate, Polyvinyl chloride, Polycarbonate, or like polymer products from synthetic or natural sources), including transparent, opaque, or semi-opaque materials of any number of colors. The toothbrush holder apparatus may also include or be integrated with any number of foam, rubber, or other flexible materials to facilitate a soft handle or soft brushing surface.

Although the present structures were described with use cases for young children, and certain dimensions for the shape of the toothbrush holder and toothbrush, it will be understood that other sizes and formats of toothbrushes may be used with the present configuration. For example, the present toothbrush design may be adapted for use with adult toothbrushes, such as for use by caregivers of convalescent, disabled, or elderly persons. It will be understood that the composition of the toothbrush holder apparatus and toothbrush may be manufactured from any number of materials in addition to molded plastic, such as any number of medical- or food-grade materials that are suitably firm or rigid to support manual manipulation of a toothbrush. Additionally, a variety of modifications may be made to the presently described toothbrush holder apparatus to fit other types of toothbrushes used for persons, animals, and the like.

The above detailed description includes references to the accompanying drawings, which form a part of the detailed description. The drawings show, by way of illustration, specific examples in which the invention can be practiced. These examples are also referred to herein as "examples." Such examples can include elements in addition to those shown or described. However, the present inventor also contemplates examples in which only those elements shown or described are provided. Moreover, the present inventor also contemplates examples using any combination or permutation of those elements shown or described (or one or more aspects thereof), either with respect to a particular example (or one or more aspects thereof), or with respect to other examples (or one or more aspects thereof) shown or described herein.

The above description is intended to be illustrative, and not restrictive. For example, the above-described examples (or one or more aspects thereof) can be used in combination with each other. Other examples can be used, such as by one of ordinary skill in the art upon reviewing the above description.

The Abstract is provided to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. Thus, the following claims are hereby incorporated into the Detailed Description as examples or embodiments, with each claim standing on its own as a separate example, and it is contemplated that such examples can be combined with each other in various combinations or permutations.

What is claimed is:

1. A child toothbrush holder apparatus, comprising:

a toothbrush including a handle portion and a head portion at a distal end, wherein the toothbrush includes bristles at the distal end;

a handle including a gripping portion and a cavity configured to hold the toothbrush wherein the handle portion of the toothbrush is disposed within the cavity from a first end of the handle through an opening in a second end of the handle, wherein the handle includes a secured configuration and an unsecured configuration, wherein:

in the secured configuration, the toothbrush is secured within the handle with a support feature; and in the unsecured configuration, the toothbrush is removable from the handle;

a stopper coupled to the handle, wherein the stopper is located at a distance from the distal end of the toothbrush;

an adapter extending from the stopper and including an opening to the cavity, the adapter having a convex shape extending from the stopper, wherein the toothbrush is located within the opening, wherein the convex shape extends from a first end to a second end of the adapter, wherein the adapter is tapered at a first angle between the second end of the adapter and a center area of the adapter and at a second angle between the center area and the first end of the adapter, and wherein the adapter has a size and shape to inhibit insertion of the toothbrush into a mouth of a person further than the adapter; and a first support feature extending substantially across a diameter of the cavity of the handle, the first support configured to hold the toothbrush within the handle.

2. The child toothbrush holder of claim 1, wherein the first support comprises a molded plastic plate extending across the diameter of the cavity of the handle.

3. The child toothbrush holder of claim 1, wherein the first support is configured to clamp the handle portion of the toothbrush when the handle portion of the toothbrush is within the handle.

4. The child toothbrush holder of claim 3, further comprising:

a second support feature extending substantially across the diameter of the cavity of the handle, the second support configured to, together with the first support, hold the toothbrush within the handle.

5. The child toothbrush holder of claim 4, wherein the first support and the second support are integrated into the handle.

6. The child toothbrush holder of claim 5, wherein the first support includes a holding portion plastically welded to the handle of the toothbrush.

7. The child toothbrush holder of claim 4, wherein the first support and the second support are spaced apart within the cavity to define three sub-cavities.

* * * * *